United States Patent [19]

Doori

[11] 4,159,001

[45] Jun. 26, 1979

[54] PRESSER FOOT FOR A CONCEALED SLIDE FASTENER

[75] Inventor: Hisashi Doori, Kurobe, Japan

[73] Assignee: Yoshida Kogyo K K, Tokyo, Japan

[21] Appl. No.: 859,558

[22] Filed: Dec. 12, 1977

[30] Foreign Application Priority Data

Dec. 21, 1976 [JP] Japan ..... 51/171655[U]

[51] Int. Cl.[2] ..... D05B 29/08; D05B 35/06

[52] U.S. Cl. ..... 112/150; 112/151; 112/235

[58] Field of Search ..... 112/150, 151, 52, 235, 112/240

[56] References Cited

U.S. PATENT DOCUMENTS

| | | | |
|---|---|---|---|
| 1,852,482 | 4/1932 | Seavers et al. | 112/235 |
| 2,174,290 | 9/1939 | Max | 112/235 |
| 3,005,429 | 10/1961 | Weschler | 112/235 |
| 3,140,680 | 7/1964 | Brenner | 112/151 |
| 3,349,736 | 10/1967 | Howell | 112/235 |
| 3,735,718 | 5/1973 | Vizgirda et al. | 112/235 |
| 4,018,174 | 4/1977 | DiBenedetto et al. | 112/235 |

FOREIGN PATENT DOCUMENTS

| | | | |
|---|---|---|---|
| 1135277 | 8/1962 | Fed. Rep. of Germany | 112/235 |
| 1097884 | 2/1955 | France | 112/151 |
| 1259508 | 1/1972 | United Kingdom | 112/235 |

*Primary Examiner*—Wm. Carter Reynolds
*Attorney, Agent, or Firm*—Bucknam and Archer

[57] ABSTRACT

A presser foot for a concealed slide fastener has a sole plate slidably supported on a stem, the sole plate having in its sole a pair of guide grooves extending along the length thereof. A first needle hole in the sole plate is located between the guide grooves and a second needle hole therein is located at one side of the sole plate. The sole is divided by the guide grooves into two portions, one of which is wider than the other, the second needle hole being provided in the wider sole portion. A throat plate of a sewing machine has a third needle hole and a pair of spaced slots one on each side of the third needle hole, the slots receiving a pair of feed dogs, respectively. The sole plate is slidable sideways relative to the stem across the feed dogs between a first position in which the first and third needle holes are in registry with each other with the feed dogs facing the sole portions, respectively, and a second position in which the second and third needle holes are in registry with each other with one of the feed dogs facing the wider sole portion.

3 Claims, 9 Drawing Figures

PRESSER FOOT FOR A CONCEALED SLIDE FASTENER

BACKGROUND OF THE INVENTION

1. Field of the Invention

The present invention relates to a presser foot for sewing a concealed slide fastener to a garment.

2. Prior Art

One known type of sewing machines for concealed slide fasteners includes a presser foot that can be used for sewing the fastener to the main fabric of a garment and also for sewing the backing to the fastener or sewing seams. The presser foot includes a sole plate having a central needle hole located between a pair of guide grooves provided in its sole and a pair of side needle holes located at the sides of the sole plate.

When sewing the fastener to the main fabric, the sewing needle is aligned with and moves up and down through the central needle hole with one of the rows of the fastener elements being received in one of the guide grooves. For sewing the backing to the fastener or sewing seams with the presser foot, the sole plate is displaced sideways to bring one of the side needle holes into alignment with the sewing needle. With this displacement, however, one of the feed dogs of the sewing machine gets just below one of the guide grooves and, while being operated, is unable to press the fabric pieces positively against the sole of the sole plate. Accordingly, with the prior presser foot, the fabric pieces cannot be fed smoothly under the presser foot so that the fabric pieces are sewn by stitches at irregular intervals and the stitched fabric pieces are liable to get puckered or wavy.

SUMMARY OF THE INVENTION

A sewing machine according to the present invention comprises a presser foot which includes a sole plate having a first needle hole located between a pair of guide grooves in its sole and a second needle hole located at one side of the sole plate, the sole being divided into two portions one on each side of the guide grooves. One of the sole portions is wider than the other and the second needle hole is provided in the wider sole portion. A throat plate has a pair of slots in which a pair of feed dogs are disposed and a third needle hole located between the slots. The sole plate is movable relative to its support stem between a first position in which the first needle hole is in registration with the third needle hole with each of the feed dogs facing one of the sole portions and a second position in which the second needle hole is in registration with the third needle hole with one of the feed dogs facing one of the sole portions.

An object of the present invention is to provide a sewing machine presser foot for a concealed slide fastener which can facilitate sequential steps of sewing seams in a garment, sewing the backing of the garment to the slide fastener, and sewing the slide fastener to the main fabric.

Another object of the present invention is to provide a sewing machine presser foot which allows fabric pieces to be fed smoothly and accurately for sewing them with stitches at a regular interval and without being wrinkled.

The above and other objects and advantages of the present invention will become apparent from the following description when taken in conjunction with the accompanying drawings.

DESCRIPTION OF THE PREFERRED EMBODIMENTS

Figure 1:
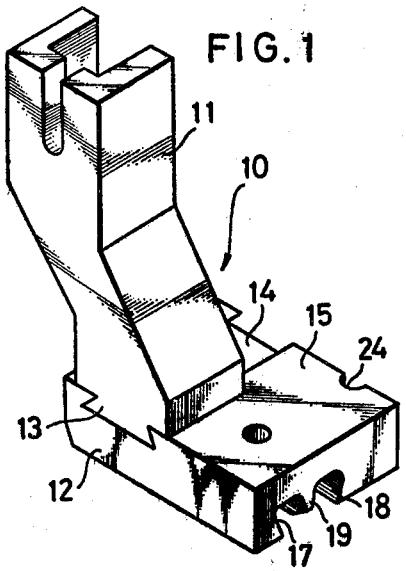
FIG. 1 is a perspective view of a presser foot provided in accordance with the present invention.
Figure 2:
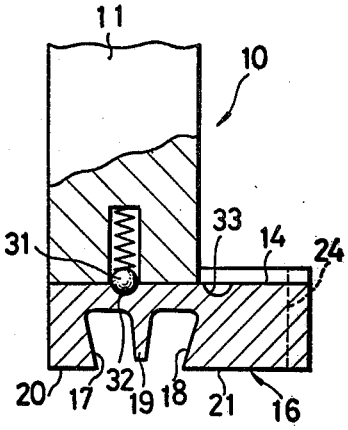
FIG. 2 is a vertical cross-sectional view of the presser foot, showing locking means between a stem and a sole plate.

As shown in FIGS. 1 and 2, a presser foot 10 comprises a stem 11 fixed at its upper end to a presser bar (not shown) extending downwardly from a sewing machine head, and a sole plate 12 slidably supported on the lower free end of the stem 11. The stem 11 and the sole plate 12 are coupled together through a dovetail joint including a tenon 13 on the lower free end of the stem 11 and a mortise 14 in a top surface 15 of the sole plate 12, the tenon 13 being slidably fitted in the mortise 14. The mortise 14 is located at a rear portion of the sole plate 12 and extends transversely to the length of the sole plate 12.

The sole plate 12 has in its sole 16 a pair of spaced guide grooves 17,18 extending all the way along the length of the sole plate 12. Between the guide grooves 17,18, there is a partition 19 projecting downwardly and having its distal edge terminating just short of the sole 16. The guide grooves 17,18 diverge away from each other from the sole 16 toward the top surface 15. The partition 19 is located off the longitudinal central axis of the sole plate 12; that is, the guide grooves 17,18 as a whole are disposed closer to one side of the sole plate 12 than to the other.

The sole 16 is divided by the guide grooves 17,18 into a first portion 20 and a second portion 21, both extending parallel to the guide grooves 17,18. The second sole portion 21 is wider than the first sole portion 20.

The sole plate 12 has therein a first needle hole 22 for the passage therethrough of a sewing needle 23 (FIG. 3), the first needle hole 22 being located forwardly of the mortise 14 in the sole plate 12 and extending through the partition 19 and centrally between the guide grooves 17,18. A second needle hole 24 is provided in the sole plate 12 and located at one of the sides thereof which is adjacent to the second sole portion 21. The second needle hole 24 is substantially semicircular in cross section throughout its entire length so that it opens at the side of the sole plate 12. The first and second needle holes 22,24 are held in alignment with each other in a direction parallel to the mortise 14 extending across the sole plate 12.

Figure 3:
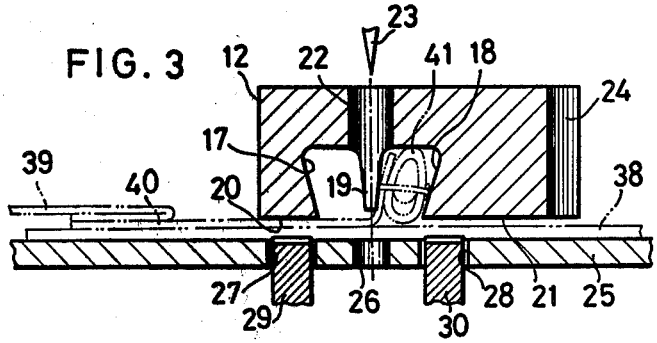
FIG. 3 is a vertical cross-sectional view showing the relative position between the sole plate and a throat plate when sewing a slide fastener stringer to the main fabric of a garment.
Figure 4:
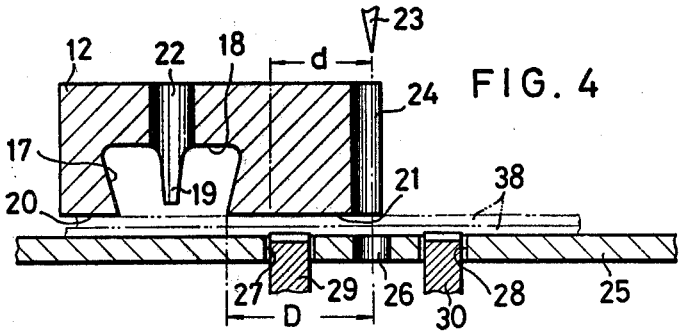
FIG. 4 is a view similar to FIG. 3, showing the relative position when sewing a seam.

In FIGS. 3 and 4, a throat plate 25 of the sewing machine is provided below and spaced from the sole plate 12, the throat plate 25 facing the sole 16 thereof. The throat plate 25 has therein a third needle hole 26 disposed in vertical registration with the sewing needle 23. The throat plate 25 also has a pair of slots 27,28 one on each side of the third needle hole 26, the slots 27,28 being spaced apart from each other a distance that is smaller than the width of the sole plate 12. More specifically, when the first needle hole 22 is vertically aligned with the third needle hole 26, the slots 27,28 are disposed below the sole portions 20,21, respectively, at positions just outside the guide grooves 17,18, as shown in FIG. 3.

A pair of feed dogs 29,30 extend into the slots 27,28, respectively. During sewing operation, the feed dogs 29,30 move back and forth to feed fabric pieces intermittently under the sole plate 12.

The sole portion 21 has a width such that when the second needle hole 24 is held in vertical registration with the third needle hole 26 as illustrated in FIG. 4, a distance D between the center of the third needle hole 26 and an edge defining the guide groove 18 that is remote from the partition 19 is greater than a distance d between the center of the third needle hole 26 and an edge of the feed dog 29 that is remote from the third needle hole 26. The sole plate 12 is slidable relative to the stem 11 through the dovetail joint in a direction transverse to the feed dogs 29,30 between a first position (FIG. 3) in which the first needle hole 22 is held in registration with the third needle hole 26 with the feed dogs 29,30 facing the sole portions 20,21, respectively, and a second position (FIG. 4) in which the second needle hole 24 is held in registration with the third needle hole 26 with the feed dog 29 facing the sole portion 21.

As illustrated in FIG. 2, the stem 11 has a spring-loaded ball 31 biased toward the sole plate 12, and the sole plate 12 has a pair of semispherical recesses 32,33 each receptive of the ball 31. The recesses 32,33 are located in the mortise 14 and spaced from and aligned with each other in a direction in which the sole plate 12 is slidable relative to the stem 11. Thus the sole plate 12 is lockable in the first position when the ball 31 is received in the recess 32 and in the second position when the ball 31 is received in the recess 33.

Figure 5:
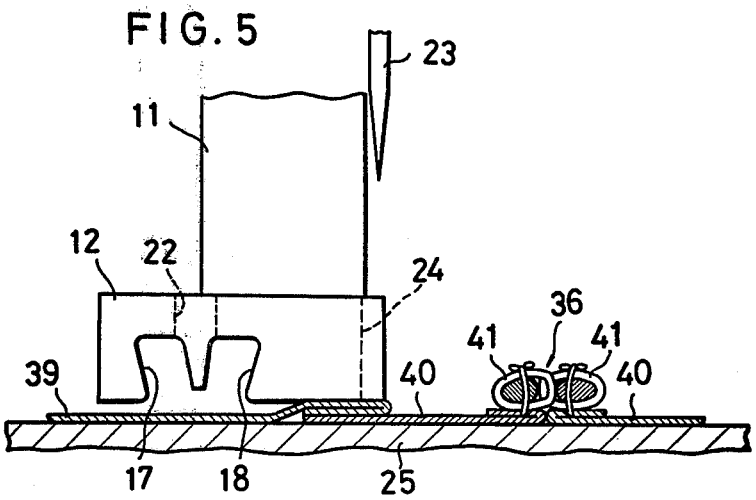
FIG. 5 is a front elevational view of the presser foot used for sewing the backing of a garment to a slide fastener stringer.
Figure 7:
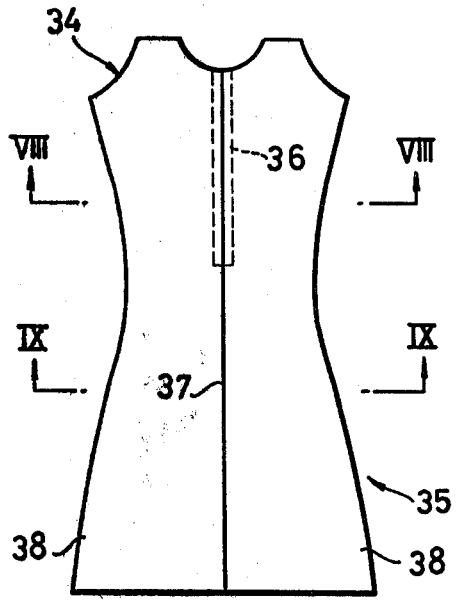
FIG. 7 is a plan view of the back of a one-piece dress to which a concealed slide fastener is attached.
Figure 8:
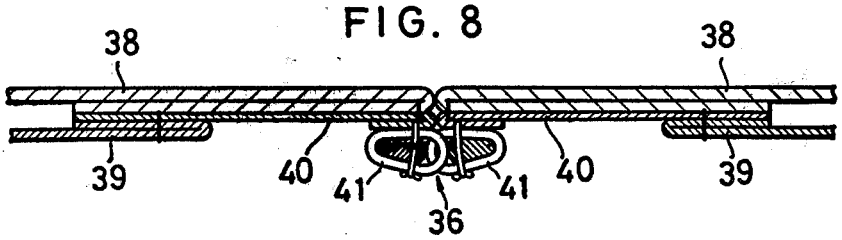
FIG. 8 is an enlarged cross-sectional view taken along line VIII—VIII of FIG. 7.
Figure 9:
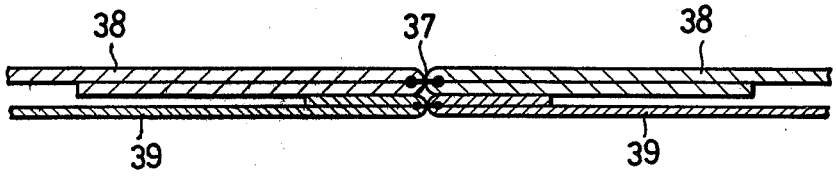
FIG. 9 is an enlarged cross-sectional view taken along line IX—IX of FIG. 7.

When making the back 34 of a one-piece dress 35 with a concealed slide fastener 36 as shown in FIG. 7, it is customary to sew a seam 37 between the two main fabric pieces 38,38 of the back 34 leaving a fastener opening, to sew backing pieces 39,39 (FIG. 8) to the stringer tapes 40,40 of the slide fastener 36, and then to sew the stringer tapes 40,40 to the main fabric pieces 38,38 of the back 34. More specifically, with the sole plate 12 of the presser foot 10 held in the second position as shown in FIG. 4, the main fabric pieces 38,38 of the back 34 are overlapped one on the other and placed between the sole plate 12 and the throat plate 25. During sewing operation, the fabric pieces 38,38 are fed positively by the feed dog 29 because the latter presses the fabric pieces 38,38 against the sole portion 21 on its advancing stroke. For attaching the backing fabric 39 to the fastener stringer tape 40, the sole plate 12 is locked also in the second position as illustrated in FIG. 5, and the stringer tape 40 with the fabric 39 on its wrong side is inserted between the sole plate 12 and the throat plate 25 for stitching by the sewing needle 23.

Then, the sole plate 12 is moved to and held in the first position (FIG. 3). The main fabric piece 38 of the back 34 is put on the throat plate 25 and the stringer tape 40 is placed on the fabric piece 38 with its row of elements 41 received in the guide groove 18. As the fabric piece 38 and the stringer tape 40 are moved forward by the feed dogs 29,30, they are sewn together by the sewing needle 23.

Figure 6:
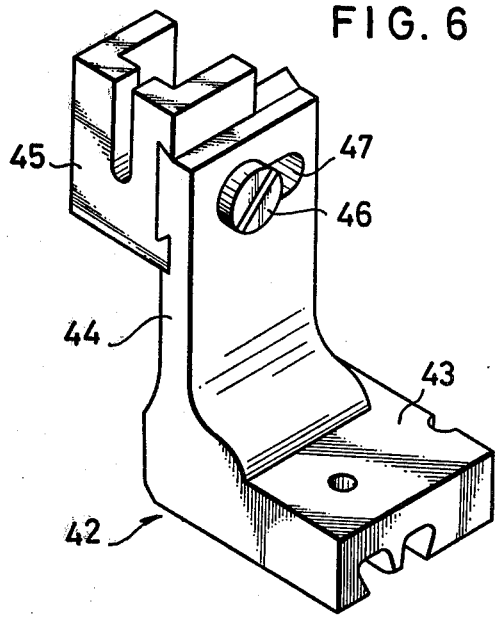
FIG. 6 is a perspective view of a modified presser foot.

FIG. 6 shows a modified presser foot 42 comprising a sole plate 43 and a shank 44 projecting upwardly from and integral with the sole plate 43. The shank 44 is connected through a dovetail joint to a stationary stem 45 extending downwardly from a sewing machine head (not shown). The shank 44 is slidable sideways relatively to the stem 45 and lockable in a selected position by a screw 46 extending into the stem 45 through an oblong hole 47 in the shank 44.

Although preferred embodiments of the invention have been shown and described in detail, it will be understood that various other modifications or changes may be made without departing from the scope of the appended claims.

I claim as my invention:

1. In a sewing machine usable for sewing a concealed slide fastener having a pair of rows of fastener elements, the improvement comprising:

(a) a presser foot including:

(1) a stem; and (2) a sole plate slidably supported by said stem and having a pair of spaced guide grooves each for receiving a corresponding one of the rows of fastener elements, said sole plate having two fabric-pressing surface portions extending parallel to said grooves, said sole plate having therein a first needle hole located between said grooves and a second needle hole located at one of the sides of said sole plate;

(b) a throat plate spaced from said sole plate and facing said sole plate, said throat plate having therein a needle-receiving hole and a pair of spaced slots on each side of said needle-receiving hole;

(c) a pair of feed dogs extending into said spaced slots; and (d) said presser foot being slidable relative to said stem across said feed dogs between a first position in which said first needle hole is in registration with said needle-receiving hole with each of said feed dogs facing a respective one of said fabric-pressing surface portions and a second position in which said second needle hole is in registration with said needle-receiving hole with only one of said feed dogs facing a corresponding one of said fabric-pressing surface portions, said fabric-pressing surface portions being positioned in relation to said grooves such that when the presser foot is positioned at each of said first and second positions neither of said slots of the throat plate faces the opening of a groove whereby fabric passed under the sole plate and over a slot of the throat plate is pressed against a corresponding fabric-pressing surface portion by the feed dog extending into such slot.

2. A sewing machine according to claim 1, said stem being coupled with said sole plate through a dovetail joint including a tenon on said stem and a mortise in said sole plate in which said tenon is slidably fitted, and said mortise extending in a direction transverse to said grooves.

3. A sewing machine according to claim 2, said stem having a spring-loaded ball, said sole plate having a pair of spaced recesses each receptive of said spring-loaded ball and located in said mortise, said recesses being aligned with each other in said direction, and said sole plate being lockable in said first position when said ball is received in one of said recesses and in said second position when said ball is received in the other of said recesses.

* * * * *